US005125564A

United States Patent [19]

Capy

[11] Patent Number: 5,125,564

[45] Date of Patent: Jun. 30, 1992

[54] PLEATED PACKAGING WRAPPER FOR OBJECTS

[75] Inventor: Gilbert Capy, Jarnioux, France

[73] Assignee: Akiva Buchberg, Paris, France

[21] Appl. No.: 687,381

[22] Filed: Apr. 18, 1991

[30] Foreign Application Priority Data

Oct. 26, 1990 [FR] France ..... 90 13589

[51] Int. Cl.[5] ..... B65D 65/12

[52] U.S. Cl. ..... 229/87.03; 229/90; 229/DIG. 3; 383/120

[58] Field of Search ..... 229/87.01, 87.03, 90, 229/DIG. 3; 220/903, 411, 412; 383/120

[56] References Cited

U.S. PATENT DOCUMENTS

| | | | |
|---|---|---|---|
| 563,962 | 7/1896 | Hinde | 229/90 X |
| 588,690 | 8/1897 | Brown | 229/90 |
| 1,165,644 | 12/1915 | Wood | 206/304.1 |
| 2,586,078 | 2/1952 | O'Malley | 229/87.03 X |
| 2,617,549 | 11/1952 | Egger | 220/903 X |
| 2,705,104 | 3/1955 | Vogt | 229/87.03 |
| 3,908,523 | 9/1975 | Shikaya | 229/90 X |
| 4,795,648 | 1/1989 | Capy et al. | 383/120 X |

FOREIGN PATENT DOCUMENTS

| | | | |
|---|---|---|---|
| 4212 | of 1899 | United Kingdom | 229/90 |

*Primary Examiner*—Stephen Marcus
*Assistant Examiner*—Jes F. Pascua
*Attorney, Agent, or Firm*—Kane, Dalsimer, Sullivan, Kurucz, Levy, Eisele and Richard

[57] ABSTRACT

A wrapping for arbitrary objects is formed of a pleated sheet having sides disposed along curves of various shapes. A tape may be attached to the sheet for fixing the pleats and for closing the end openings formed when the sheet is trained around the object. The pleats may increase in size as they progress from one lateral edge to the other.

17 Claims, 4 Drawing Sheets

PLEATED PACKAGING WRAPPER FOR OBJECTS

BACKGROUND OF THE INVENTION

A. Field of Invention

This invention pertains to an improved pleated packaging wrapper which may be folded prior to use, and a method of making the same.

B. Description of the Prior Art

In U.S. Pat. No. 4,795,648 there is described a packaging made from a thin sheet which is pleated and the borders of its pleats are affixed to one another by various methods. The pleats are knife pleats. The dimensions of the pleats are selected to conform to the nature of the object to be packaged and with the distance between the welds. The pleats are fixed at the ends, and are free at the middle, such that when they are opened up they form a hollow shape which is suitable for wrapping round sandwiches and the like. The patent describes a method enabling this type of shape to be obtained from a flat sheet by making parallel knife pleats which give the folded wrapping a substantially planar configuration that is expanded up by unfolding.

In the present invention a more generalized method and structure is described, which makes it possible to make wrappings adapted both to sandwiches and to any other kinds of objects as diverse as dishes, pizzas, fruits, sanitary napkins, or beauty products.

OBJECTIVES AND SUMMARY OF THE INVENTION

An objective of the present invention is to provide a wrapping made of a pleated sheet and adapted to wrap objects having arbitrary shapes.

A further objective is to provide a sheet with reinforced sides to resist tearing.

Yet another objective is to provide a wrapping with closing means for closing the open ends formed when the sheet is wrapped around the object.

A further objective is to provide a wrapping which may be made easily by using automated machinery. Other objectives and advantages of the invention shall become apparent from the following description. A wrapping for an object of arbitrary shape includes a pleated sheet with two opposed sides, said sides following two corresponding curves. The curves may be shaped as concentric, or non-concentric arcs of circle, as arcs of spirals, or other similar shapes. The pleats may be trapezoidal and may increase in length progressively from one lateral edge to the other. Advantageously, the pleats may extend beyond the fixing line to form closing means for the wrapping. Alternatively a tape may be secured to the sheet to form the closing means and/or to reinforce the sheet at the sides.

DETAILED DESCRIPTION OF THE INVENTION

Figure 1:
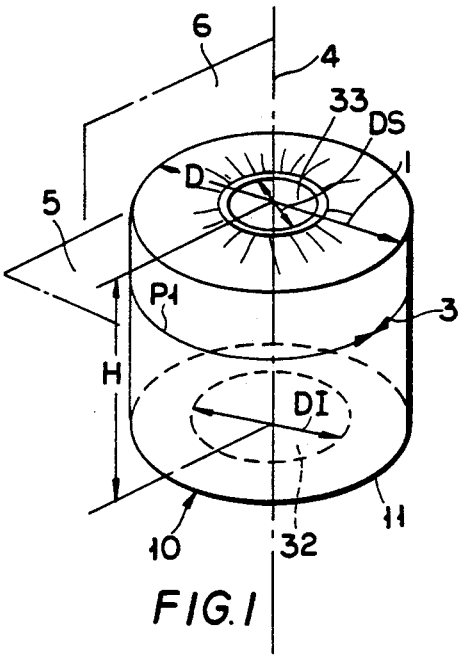
FIG. 1 shows a wrapper having a cylindrical shape according to the invention.

For the sake of simplicity, it is assumed that it is desired to wrap a cylindrical object 10 as in FIG. 1 having the diameter D and the height H. Of course, the packaging 11 must be slightly larger than the object which it is to cover. For the sake of simplicity this excess disregarded.

Figure 2:
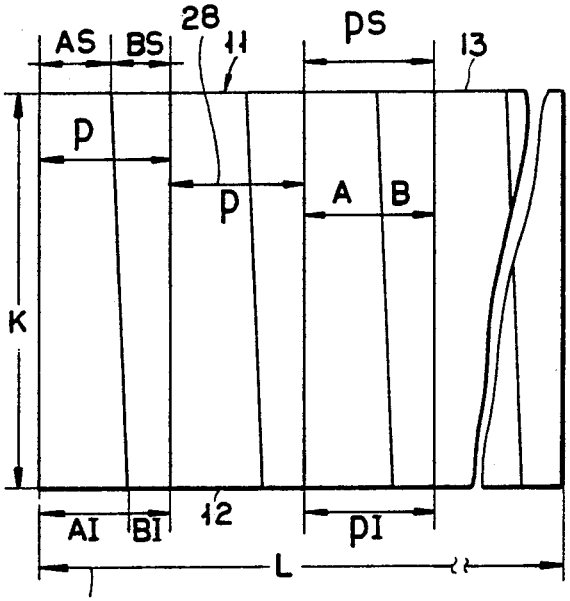
FIG. 2 shows substantially a rectangular sheet prior to pleating, showing the position of the pleats and their orientation.
Figure 3:
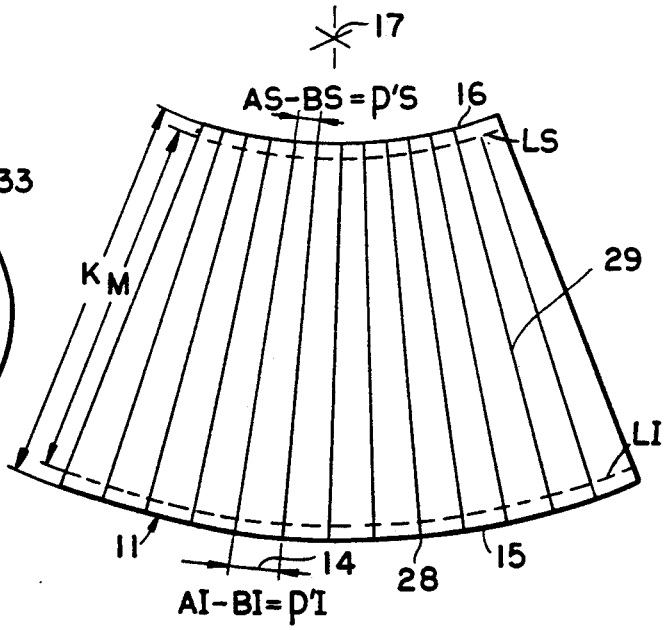
FIG. 3 shows the pleated packaging according to the invention, formed from the sheet shown in FIG. 2.
Figure 13:
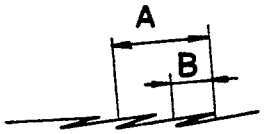
FIG. 13 shows a cross section of the flattened pleats which no longer overlap when B is small than one-half of A.

The size of the packaging 11 is determined on the basis of the perimeter P1 defined at the intersection with a plane 5 perpendicular to the axis of revolution 4 of the cylindrical object. Perimeter P1 is equal to $\pi$*D. Perimeter P2 of object 10 is equal to 2(H+D), where D is the diameter of the object and H is its height. This packaging must surround the cylindrical portion of the object, and then define, on the upper and lower portions, two substantially circular zones 33 and 32 not covered by the wrapping and having diameters DS and DI respectively, with the axis 4 of the object passing through the center. Packaging 11 consists of a rectangular sheet (FIG. 2) whose length L is substantially equal to P1 and whose width is substantially equal to (P2-[DI+DS−])/2. The length of the wrapping at its center, after unfolding, remains equal to P1 while the length of the bottom and top sides 12, 13 is given by LI=π×DI and LS=π*DS respectively. It is noted that the top and bottom sides of the folded packaging do not have the same length. To reduce the length L to LI and LS in FIG. 3, the size of the pleats will not be the same on one side as they are on the other. For a packaging with N pleats, the length of sheet used for one pleat 28, i.e. the pitch, p (FIG. 2) is p=P1/N. Since the pleat is laid flat, each pleat 28 is partitioned into a section having a width A which is the larger section of the pleat, and a smaller section with a width B. The difference A-B corresponds to the pitch p' of the sides of the wrapping when the pleats are finished. Consequently, for the upper part, this pitch is given by p'S=LS/N=AS-BS, and for the lower part, p'I=-LI/N=AI-BI, where AS and BS are the widths of sections A and B along side 13 and AI, BI are the widths of sections A,B along side 12, as shown in FIG. 2. From this relationship it is possible to deduce the corresponding values of AS and BS, as well as those of AI and BI which define the change of shape of the pleat since AI+BI=AS+BS=p. It will be necessary to verify, by successive iterations, that the chosen number of pleats N corresponds to an acceptable operating range for the packaging. In particular, it is preferable to select A such that (P1/31.4)<A<(P1/12.6) and (A/3)<B<5AI/6), (p1/31.4)<AS,<P1/12.6) and (AS/3<BS<(5AS/6). It will be noted that, when B>(A/3), the knife pleats are superimposed such that has a thickness which is either of 3 or 5 times the thickness of the sheet. When B<A/2 See FIG. 13 the knife pleats do not cover one another. The wrapping will have a thickness which is only 1 or 3 times the thickness of the sheet. At the time of fabrication, if the wrappers are made from a spool, it is easier to separate the wrappers from one another at a point where the wrapping has the thickness of a single sheet. It is useful, in that case, to create areas at every Nth fold where there will be only one sheet thickness if such areas do not exist already or if they are too narrow.

The packaging, before unfolding, if it is assumed that the pleats 28 are substantially perpendicular to the fixation lines 15, 16 is in a shape developed from a truncated cone. When the packaging is laid flat as in FIG. 3, the sides, 15 and 16 then form two arcs of concentric circles. The pleats 29 are no longer parallel to one another and they converge toward an area approaching center 17 of concentric circles formed by sides 15 and 16. When the wrapping is put around the cylindrical object of FIG. 1, its margins expose a portion of the top surface defined by a circle 7 of the length LS and a portion of the bottom surface defined by a circle 8 of length LI. If LI=LS the folded packaging which was a development of a truncated cone of revolution becomes a development of a cylinder of revolution, and the pleats are then parallel as described in the case of a wrapping for sandwiches.

Figure 14:
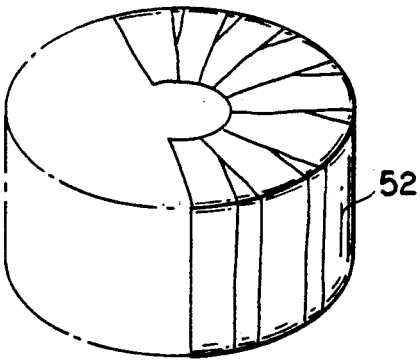
FIG. 14 shows an object partially covered by the wrapping according to the invention, so that the wrapping will serve as a means of holding the object.

To wrap this cylinder in a sheet, the sheet must have a length L=k*P1, where k is coefficient with the value of 1 in the example that has just been described. If k is between 1 and 2, the packaging is partially or totally overlapped. If k is less than 1 the product is not completely covered. For example, k is less than 1 as shown in FIG. 14 if it is desired to use this packaging 52 only to hold the object and consequently it is not necessary that the object be covered completely. In general for the sandwich package which we have described, k=1+(alpha), where alpha generally assumes a value between −1 and O. However, it is possible to have alpha >0 in certain cases, and to use a wrapper that is not fully unfolded. The lengths of the side sections of the pleats 12 and 13 of the wrapper become LI=K-*pi*DI and lS=K*pi*DS.

Figure 6:
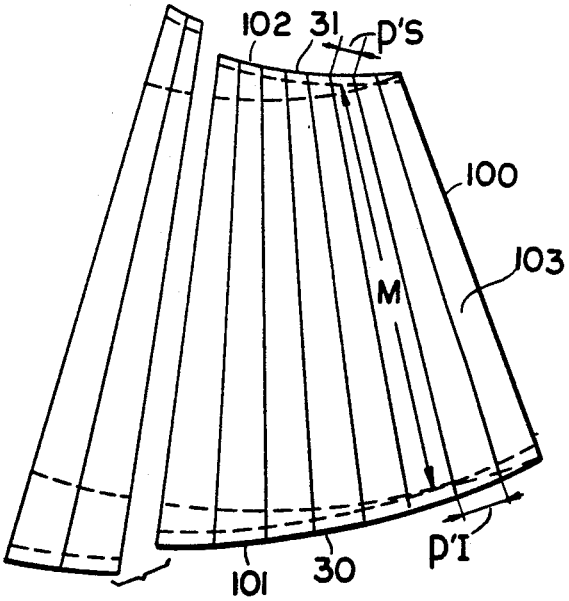
FIG. 6 shows another embodiment of the invention, wherein the distance between the areas of fixation of the pleats varies to facilitate the covering of the wrapping in the course of assembly.

When k is greater than 1, it may be desirable to increase the distance between the pleat fixation areas in the area where the wrapping covers itself, because the volume has changed. The wrapping 100 in FIG. 6 is not defined by two concentric sections of circles like in FIG. 3. Instead the spacing between the two side sections 101, 102 of the pleats 103 in FIG. 6 is increased from pleat to pleat by between 5% and 15%. This may be achieved by shaping the margin corresponding to the largest opening 32 in FIG. 1 to a section of a first centrifugal Archimedean spiral 30 and shaping the margin corresponding to the smaller opening 33 into a section of a second centripetal Archimedean spiral 31. Alternatively, spacing can be achieved in numerous other ways.

Figure 4:
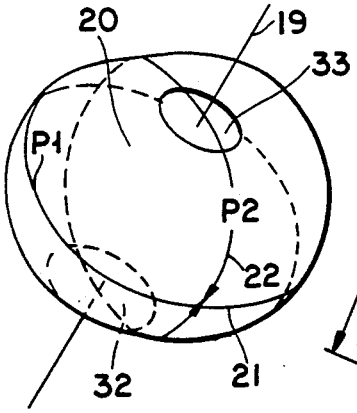
FIG. 4 shows a convex object which can be wrapped in the packaging according to the invention.

The object to be wrapped has been defined as a cylinder to simplify the explanation. It is possible, however, to use this type of wrapping to wrap all kinds of objects, convex or not convex. If an object has concavities, it will suffice to consider the smallest imaginary convex volume that can be circumscribed on the said object having concavities. In the rest of this description we will take into account only convex volumes. To determine the axis 19 in FIG. 4 around which the packaging material is to be wrapped, it is known that it passes through the center of gravity 20 of the convex volume. If desired, any direction can be selected for this axis 19, and it will always be possible to determine a wrapping, but it will not be optimized, particularly from the viewpoint of the area of the sheet used. Generally, the choice will be made on an empirical basis and is dictated by common sense.

Figure 17:
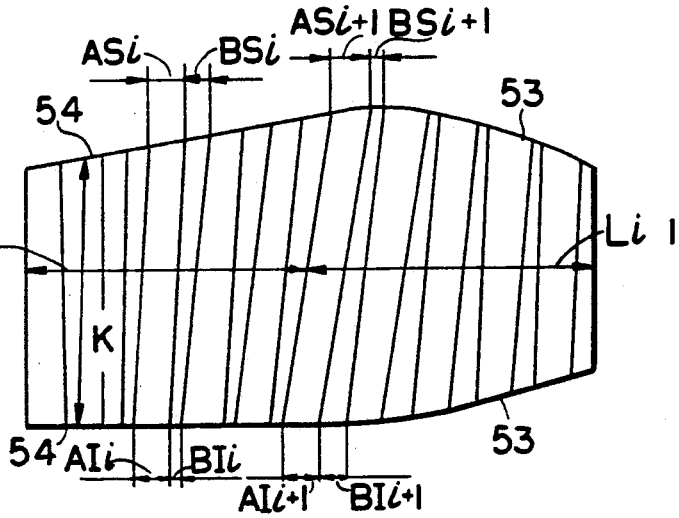
FIG. 17 shows a portion of a sheet to make a wrapping according to the invention wherein two adjacent pleated sections have different shapes.

If it is desired to make a careful selection it will suffice to choose an x-axis 19 (FIG. 4) of zero resultant moment, with respect to all points on the surface, and passing through the center of gravity 20 of the convex volume. If one considers all of the intersecting curves of the convex volume in question which have planes perpendicular to the x-axis 19, P1 is the length of the longest curve of intersection 21. Then one determines the various values of P2 defined by the total of the lengths of the curves 22 intersecting the planes passing through the x axis 19. Lastly, a certain number N of sectors in FIG. 17 is determined, in each of which the parameters of the wrapping can be considered to be constant. Each sector is of the length Li=ki=*P1, i being able to assume values from 1 to n such that k=k1 +k2 . . . +ki= . . . +kn, and for each sector it is possible to determine LIi and LSi and to determine the most appropriate shape of the pleats by applying to each sector the formulas given in the above description, names:

(P1/31.4)<Ai<(P1/12.6) and (Ai/3<Bi<(5Ai/6), and at the ends, (P1/31.4)<AIi−(P1/12.6) and (AIi/3-)<BIi<(5AIi/6), (P1/31.4)<ASi<(P1/12.6) and (ASi/3<BSi<(5ASi/6). For each sector one can have different characteristics for the shape and the length of the pleats. Particularly the margins of the wrapper, whose bottom margin length is LI=LIl+LI2+ . . .

+LIi . . . +LIN and whose upper margin length is LS=LSI +LS2+ . . . +LSi+ . . . +LSn, taking a shape which depends on the choices made as regards the length of the pleats. The set from which this package is made is generally no longer rectangular and assumes a complex shape, being able to have rounded portions 53, a portion of oval shapes formed of discontinuous lines 54, or a combination of these types of lines (FIG. 17). In practice, it is desirable nevertheless to reduce insofar as possible the variations of shape and length of the pleats so as not to increase excessively the cost of manufacture. We have thus described how to make a package in accordance with the invention for a real or imaginary convex volume. It is quite evident that its position must be carefully marked, because there is a strict relation between each of the N sectors of the volume and the shape of the corresponding n sectors of the package.

The setting of the pleats can be performed, for example, by first coating the sheet, at least in the areas involved in the fixation of the pleats, and at least on one face, with a hot-melt material. When the sheet is folded in accordance with the present invention, the application of a hot electrode of appropriate shape will suffice to fix the pleats, and the confronting faces coated with hot-melt material will bond together. This method of fixing the pleats may not be sufficiently strong in some instances and particularly the seams may open and the layer of hot-melt material may tear away. To strengthen the pleat fixation a thin tape 34 (FIG. 7) properly sized can be used and can be adhered to the pleats 51. The shape of this tape 34 corresponds from the shape of the margins of the wrapper. For example, if the package is a development of a cone as in FIG. 3, the tape 34 in FIG. 7 can itself be a developed cone in which radius concentric with the arcs of circles and of FIG. 3. If the package is a developed cylinder with parallel pleats, this band also becomes a developed cylinder. Thus a tape comes under tension as soon as the pleats are subjected to stress and the areas of fixation then are no longer subjected to peeling forces but to shear. The tape 34 in FIG. 7 must be sufficiently wide to prevent the stress from being transmitted to its edge 35.

Figure 8:
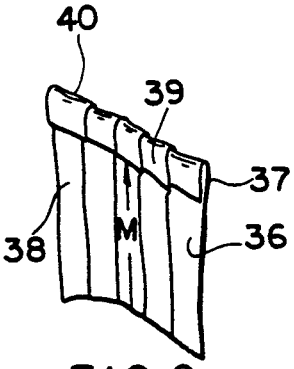
FIG. 8 shows in detail a method for reinforcing the fixation of the pleats by doubling them over at their ends.

The edge of the pleats can also be reinforced by using for the wrapping a sheet coated on one face 36 as in FIG. 8, at least in the areas 37 of the fixation of the pleats 38, with a self-sticking or heat-sealing material, and by folding back the margin 39 of the pleats 38 on itself such that the self-sticking or heat-sealing material is on the inside. The pleats 38 adhere to themselves and locking is obtained at the fold 40. When the wrapping is a developed cone (FIG. 3), this operation results in a deformation of the folded area 39 in FIG. 8, from which the pleats, if they were convergent as indicated at 15 in FIG. 3, become divergent; if, however, they were divergent as indicated at 16, they become convergent.

Figure 19:
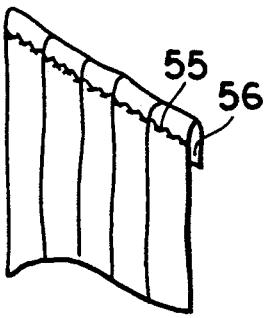
FIG. 19 shows method of fixing the pleats by sewing.

Other methods of fixation can be used, depending on the nature of the thin sheet material, such as sewing 55 as shown in FIG. 19. The sewing can be performed directly or after the margins (56) have been folded over to make a hem, or to replace or augment the methods of fixation described, particularly by heat sealing.

Figure 9:
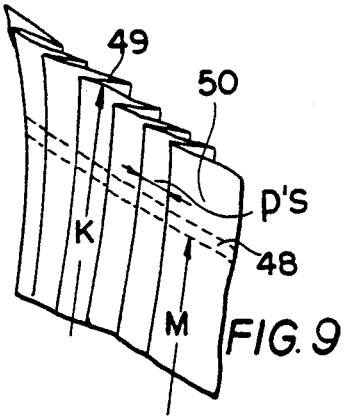
FIG. 9 shows a detail of the area of fixation of the pleats, in which the pleats have been lengthened to cover the area defined by the pleat fixation area.

We have described above a packaging which, when it is placed on the object being packed, leaves two areas uncovered, such as those referenced 32 and 33 in FIG. 1 bordered by the margins LI and LS. It is necessary in some applications that these areas be covered. One way of doing so consists in widening the wrapping so as to set the area of fixation of the pleats 48 in FIG. 9 away from the end 49 so that this pleated margin 50 will fill out the areas 32 and 33 (FIG. 1) defined by the area of fixation of the pleats. If the fixation of the pleats has been reinforced by folding over the margins as in FIG. 8, the wrapping can be widened as in FIG. 11 so as to be able to fold over the margin 41 of the pleats, affix it close to the fold 42 and then turn its end 43 outwardly so that it overlaps and covers up the areas of types 32 and 33 in FIG. 1 when it is installed. If the reinforcement consists of a thin tape as in FIG. 7, as described above, the reinforcing tapes 34 can be widened sufficiently to overlap the outside of the package. When the packaging is installed on the object to be packed, this overlapping portion can fill the areas of type 32 and 33 in FIG. 1. All of the proposed solutions which we have just described apply, of course, to the case in which LIi=LSi for any value of i from 1 to n. In the latter case, it is also possible to widened the tape 44 in FIG. 10 from the inside of the area of fixation 45 and turn it back so a to make it overlap the outside of the package. This solution is important when a sheet coated on one side with a heat-sealing material is used for making the wrapping and the reinforcing tape. The heat sealing material of the tape is turned toward the sheet in order to achieve a reinforced fixation of the pleats. By turning this tape outwardly, the face of the tape with the heat-sealing material is again turned toward the object being wrapped. If, for example, the layer of heat-sealing material is again turned toward the object being wrapped. If, for example, the layer of heat-sealing material constitutes a barrier to fats and oils to prevent the sheet from staining, all of the constituent elements of the wrapping in contact with the object being wrapped can have a coating.

Figure 7:
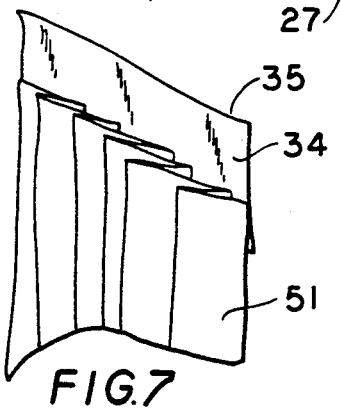
FIG. 7 shows in detail a method for reinforcing the fixation the pleats by the addition of a tape, which is widened toward the outside of the wrapping to permit filling the uncovered area limited by the hemming of the pleats.
Figure 10:
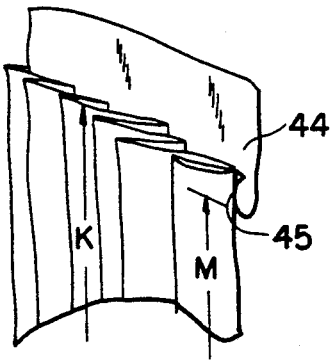
FIG. 10 shows a variant of the method for reinforcing the fixation of the pleats shown in FIG. 7, wherein the widening is done on the inside, then the tape is folded back, after fixation to cover the zone defined by the pleat fixation area.
Figure 11:
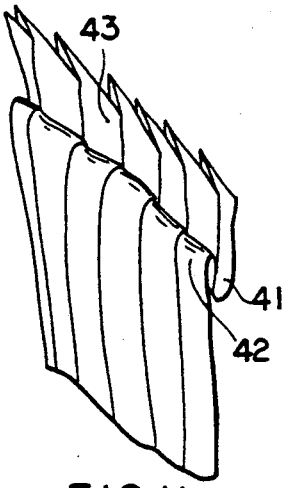
FIG. 11 shows a way of affixing the ends of the pleats similar to FIG. 8, but the length of the pleats has been increased so that the ends of the pleats can be turned outwardly in order to fill the area bordered by the pleat fixation zone.
Figure 12:
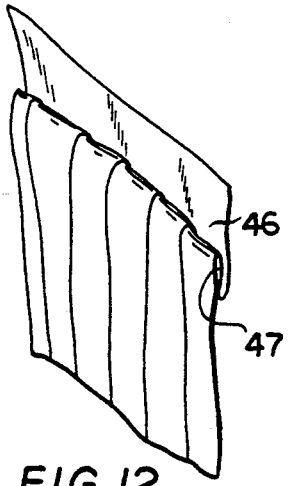
FIG. 12 shows a way of fixing the pleats combining the turning of the ends of the pleats as indicated in FIG. 8 and the placing of a tape widened toward the interior as indicated in FIG. 10.
Figure 18:
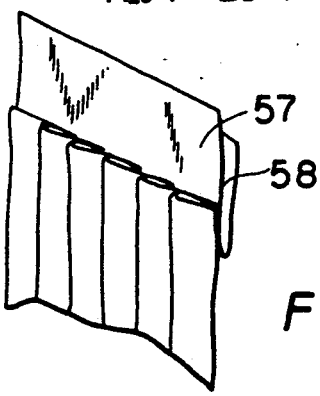
FIG. 18 shows a method of filling uncovered areas by combining the solutions described in FIG. 7 and FIG. 10.

In a variant of the invention shown in FIG. 18, the fixing tape is made to overlap both on the outside 57 as indicated in FIG. 7, and on the inside as indicated in FIG. 10 or FIG. 12, and the inner side 58 is turned to the outside so as to obtain two overlapping tapes which it will be possible after installation to turn back to fill areas 32 and 33. As an improvement in the case described of the reinforcement of the areas of fixation, in some variants of the invention the fixation of a tape 46 in FIG. 12 is combined with the folding over at 47 of the ends of the pleats. The purpose of this is on the one hand to avoid having a rough-cut edge and one that might cut the hand and to arrange to close up areas of type 32 and 33 FIG. 1 with a tape 46 as in FIG. 12. This has the advantage of limiting the accumulation of paper such as might be the case when the excess width 43 in FIG. 11 of the pleats themselves is used to perform this function.

In the solutions described for filling up the perimeter areas LI and LS we have taken as an example the areas 32 and 33 of FIG. 1. It is quite evident that these solutions also apply to the general case.

Figure 5:
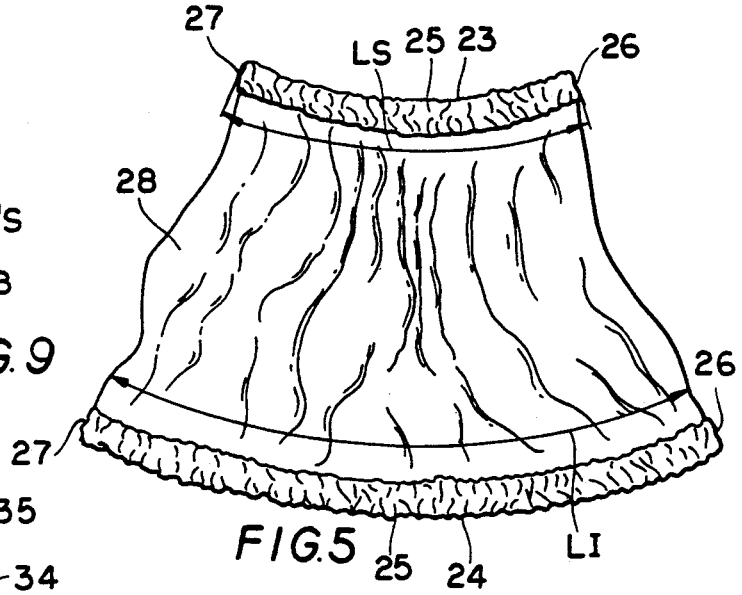
FIG. 5 shows another embodiment of the invention, wherein the pleats are replaced by gathers situated on the lateral edges.

We have taken into consideration, in the above explanations, the use of flat pleats. Actually, the function of the flat pleat is to bring the element of length Li of the sheet to the lengths LIi and LSi. The ratio of Li to LIi and LSi gives the rate of reduction of length RIi and RSi in the zone in question for a particular packaging. Various forms of pleats can be used, each of them having its limitations. In the extreme case it is possible to have no pleats at all in the sense described above, as in FIG. 5, except close to the margins 23 and 24 where they become similar to gathers like those made on a window curtain. On method of proceeding to make gathers might consist in folding back and fixing the lateral margins of the rectangular sheet in order to define on each side a longitudinal tube 25 containing, for example, a flexible tape coated with heat-sealing material. The heat-sealing tape is affixed to one end 26 of the tube 25 and skips to the other end so that it can be pulled while holding the other end of the tunnel 25 so as to produce the gathers. Then all that needs to be done is to pinch the tunnel 25 with hot electrodes to affix it to the tape and thus set the gathers. In the center area 28 the sheet forms convolutions the way a curtain would after gathering. The methods described above in connection with FIGS. 7 to 12 for the strengthening of the pleats and for the filling of areas left uncovered fully apply to this case.

Figure 15:
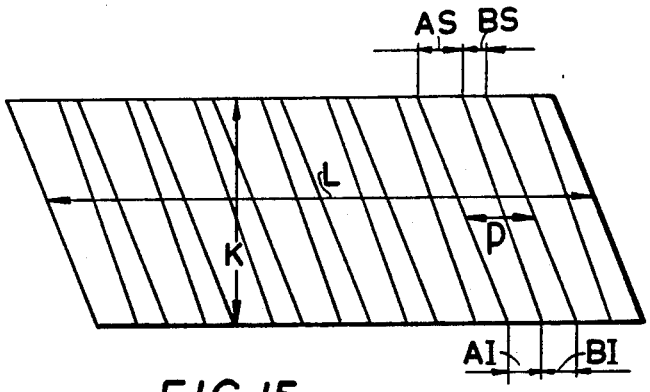
FIG. 15 shows a sheet to make a wrapping according to the invention, which is in the shape of a parallelogram.
Figure 16:
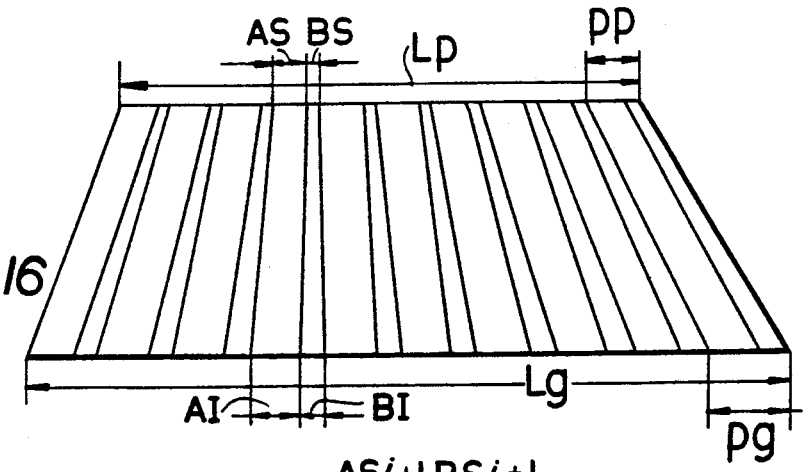
FIG. 16 shows a sheet to make a wrapping according to the invention, which is in trapezoidal form.

In the various cases which we have just described, we have taken, to help in the explanations, the example of using a rectangular sheet of the length L(FIG. 2). We have approached the general case of a sheet of variable width and variable pleat shape shown in FIG. 17. To make our explanation more precise, we are developing hereinbelow two concrete examples that are part of the general case. It is thus possible to obtain a package according to the invention from a sheet in the shape of a parallelogram FIG. 15 or trapezoid (FIG. 16). As far as the parallelogram in FIG. 15 is concerned, one side must have the length L=k*P1. The width K, which id defined as the distance between the two edges of the sheet of length L is, as a first approximation, the distance between the curves defined by the edges of length LI and LS. If the number of pleats is N, it is always possible to determine a pitch p =L/N, to determine for example N parallelograms and to calculate AI, BI, AS and BS as before. If a trapezoid as in FIG. 16 is involved, the length L of the sheet taken into account can be the average length of the bases. If, for example, Lp and Lg are the short and the long base, one obtains L−(Lp+Lg)/2+k*P1, if N is the number of pleats the sheet is divided into a series of short-base trapezoids pp=Lp/N and long-base trapezoids pg =Lg/N, with, quite obviously, the average pitch p LL/N =(pp +pg)/2* N. Having determined the shape and the length of the margin of the area defined by the edges LI and LS, it is easy to compute AI, DI, AS and BS as before.

Obviously numerous modifications can be made to the invention without departing from its scope as defined in appended claims.

We claim:

1. A wrapping for at least partially enveloping a package having an arbitrary shape, said wrapping comprising a sheet having lateral edges and first and second sides shaped along a first and a second curve, respectively, said sheet being folded into successive pleats between said lateral edges, said pleats being formed by a plurality of non-parallel folds, and first and second fixation areas disposed along said sides for fixing said pleats, wherein said wrapping may be applied by training said pleats, wherein said wrapping may be applied by training said lateral edges around said object to open said pleats with said first and second sides forming first and second corresponding end openings having different diameters.

2. The wrapping of claim 1 wherein said pleats each have a top pleat edge and bottom pleat edge, said top and bottom pleat edges having different length to define trapezoidal pleats.

3. The wrapping of claim 1 wherein said first and second curves are concentric arcs of circle.

4. The wrapping of claim 1 wherein said first and second curves are non-concentric.

5. The wrapping of claim 1 wherein said first and second curves are spiral arcs.

6. The wrapping of claim 1 wherein each pleat has two side sections corresponding to said first and second sides and separated by a distance, said distance increasing for pleats progressing from one lateral edge to the other.

7. The wrapping of claim 6 wherein said distance for adjacent pleats increases by a preselected percentage.

8. The wrapping of claim 7 wherein said percentage is in the range of 10–20%.

9. The wrapping of claim 1 wherein said pleats overlap.

10. The wrapping of claim 1 wherein said object has two perimeters P1 and P2, said openings are circles of diameters DI and DS respectively, and said sheet prior to folding has a length L substantially equal to P1 and a width W equal to (P2-[DI+DS])/2.

11. The wrapping of claim 10 wherein said sheet is folded into trapezoidal pleats, each pleat being formed of a first sheet section having a first section top width AS and a first section bottom width AI, and a second section folded over said first section, said second section having a top width BS and a bottom width BI, said top and bottom width being disposed along said first and second circles respectively, wherein AS and BS are defined by the relations:

(P1/31.4)<AS<(P1/12.6) and (AS/3)<BS<(-5AS/6).

12. A wrapping for at least partially employing an object, said wrapping comprising a sheet with a first and second opposed sides and folded into a plurality of contiguous pleats having first and second fixation areas disposed along said sides respectively for fixing said pleats, wherein said sheet can be trained around an object to form a closure with two open ends at said sides, and closing means attached to said sheet for closing said open ends, said closing means including a tape attached to said sheet along at least one of said fixation areas said tape being folded to form two overlapping layers extending along said sheet.

13. The wrapping of claim 12 wherein said tape is pleated.

14. The wrapping of claim 13 wherein said tape is folded over said fixation areas.

15. The wrapping of claim 12 wherein said tape consists of one two sections, with one section overlapping said sheet and another section extending away from said sheet.

16. The wrapping of claim 12 wherein adjacent pleats overlap.

17. A wrapping for at least partially enveloping a package having an arbitrary shape, said wrapping comprising a sheet having lateral edges and first and second sides shaped along a first and a second curve, respectively, said sheet being folded into successive pleats between said lateral edges, each said pleat having two side sections corresponding to said first and second sides and separated by a distance, said distance increasing for pleats progressing from one lateral edge to the other by a percentage in the range of 10–20%;

wherein said wrapping may be applied by training said lateral edges around said object to open said pleats with said first and second sides forming first and second corresponding end openings.

* * * * *